US006772597B1

(12) United States Patent
Zentner et al.

(10) Patent No.: US 6,772,597 B1
(45) Date of Patent: Aug. 10, 2004

(54) DEFROST CONTROL

(75) Inventors: Martin Mtichell Zentner, Prospect, KY (US); Rollie Richard Herzog, Louisville, KY (US); Peter Brand, Louisville, FL (US); Gary Lester Chastine, Louisville, KY (US); Matthew Graham Taylor, Longwood, FL (US); Tam Nolan, Solana Beach, CA (US)

(73) Assignee: General Electric Company, Schenectady, NY (US)

( * ) Notice: Subject to any disclaimer, the term of this patent is extended or adjusted under 35 U.S.C. 154(b) by 0 days.

(21) Appl. No.: 09/417,727

(22) Filed: Oct. 14, 1999

Related U.S. Application Data

(60) Provisional application No. 60/104,539, filed on Oct. 16, 1998.

(51) Int. Cl.[7] ..... F25D 21/06

(52) U.S. Cl. ..... 62/80; 62/153; 62/155; 62/234

(58) Field of Search ..... 62/151, 153, 154, 62/155, 156, 234, 228.1

(56) References Cited

U.S. PATENT DOCUMENTS 4,056,948 A 11/1977 Goodhouse
4,297,852 A * 11/1981 Brooks ..... 62/153
4,327,557 A * 5/1982 Clarke et al. ..... 62/153
4,481,785 A 11/1984 Tershak et al.
4,528,821 A 7/1985 Tershak et al.
4,531,376 A 7/1985 Alsenz
4,569,205 A 2/1986 Dempou et al.
4,646,536 A * 3/1987 Yamada et al. ..... 62/234
4,732,010 A 3/1988 Listromberg et al.
5,237,830 A 8/1993 Grant
5,369,962 A 12/1994 Szynal et al.
5,394,291 A 2/1995 Janke et al.
5,415,005 A 5/1995 Sterber et al.
5,440,893 A 8/1995 Davis et al.
5,456,087 A 10/1995 Szynal et al.
5,533,360 A 7/1996 Szynal et al.
5,924,297 A * 7/1999 Wolff et al. ..... 62/155

* cited by examiner

*Primary Examiner*—Harry B. Tanner
(74) *Attorney, Agent, or Firm*—H. Neil Houser, Esq.; Armstrong Teasdale LLP

(57) ABSTRACT

An adaptive defrost control includes a microcomputer for controlling the initiation and termination of a defrost operation based, at least in part, on opening of the fresh food door and the freezer door. The control monitors the compressor run time and the fresh food and freezer door open times and adjusts the time until defrost accordingly. A pre-chill operation cools the freezer prior to defrosting the evaporator coils so that the defrost heat will have less of an affect on the maximum temperature after defrost, and enables the freezer compartment to be maintained at a temperature a few degrees higher than with known refrigerators, providing energy savings.

20 Claims, 15 Drawing Sheets

State = Abnormal?
72
Yes
No
Abnormal
84
State = First Cycle?
74
Yes
No
First Cycle
86
State = Pull Down
76
Yes
No
Pull Down
88
State = Pre-Chill?
78
Yes
No
Pre-Chill
90
State = Dwell?
80
Yes
No
Dwell
92
State = Defrost?
82
Yes
No
Defrost
94
Comp
96

DEFROST CONTROL

CROSS-REFERENCE TO RELATED APPLICATIONS

This application claims the benefit of U.S. Provisional Application No. 60/104,539, filed Oct. 16, 1998.

BACKGROUND OF THE INVENTION

The present invention relates to defrost control in a refrigerator, and more particularly to an adaptive refrigerator defrost control.

Defrost operations are performed in refrigerators to clean the evaporator coils and to keep the coils free from frost build up. Known defrost controls for refrigerators typically are based on fixed timer controls. More specifically, and with such known controls, a defrost operation is initiated after a fixed amount of compressor run time. After the defrost operation is initiated, the control keeps the compressor off for a second fixed period of time. Defrost heat is terminated during the second fixed time period by a thermal sensing device for sensing the temperature of the evaporator coils.

The compressor run time is affected, for example, by the length of time that the fresh food and freezer doors are open. Particularly, if the doors are often open and the compartments warm, the compressor runs more than if the doors are not opened very often and the compartments remain relatively cool. Although warming of the compartments may require that the compressor run more, such warming does not necessarily require that defrost operations be performed more often. Initiating defrost operations after a fixed amount of compressor run time, however, results in performing defrost operations more often. Unnecessarily performing defrost operations results in increased, and unnecessary, energy consumption.

In addition, during defrost operations, the temperature in the freezer compartment generally is not allowed to exceed a predetermined peak temperature, e.g., about 0.5° F. To enable completion of the defrost operation without exceeding the peak temperature, the freezer compartment normally is maintained at about −7° F., which is cooler than required for normal operations but necessary to prevent excessive warming during defrost operations. If the freezer temperature during normal operations could be increased even just a few degrees without resulting in exceeding the predetermined peak temperature during defrost operations, a potentially significant energy savings could be provided.

BRIEF SUMMARY OF THE INVENTION

In an exemplary embodiment of the invention, an adaptive defrost control includes a microcomputer for controlling the initiation and termination of a defrost operation based, at least in part, on opening of the fresh food door and the freezer door, as well as the state of a defrost heater and the compressor. The adaptive defrost control monitors both the compressor run time and the fresh food and freezer door open times. For initiating defrost, a timer of the control counts toward a Maximum Time Till Defrost, which is the sum of (i) the compressor run time, (ii) the fresh food door open time multiplied by a Fresh Food Rate (negative), and (iii) the freezer door open time multiplied by a Freezer Rate (negative). Therefore, rather than a fixed period of time before initiation of a defrost operation, the adaptive control provides that the time until defrost is adjusted based on opening of the fresh food and freezer doors.

Once initiated, and during a defrost operation, the adaptive control operates the refrigerator in a pre-chill state of a fixed period of time. The pre-chill state is provided so that the freezer is cooled prior to applying heat to the evaporator coils so that the defrost heat will have less of an affect on the food temperature and on the maximum temperature after defrost. Therefore, when the control has determined that a defrost operation should be initiated, the heating portion of a defrost is preceded by a Pre-Chill Time when the compressor is held on without regard to a cold control demand for cooling. The pre-chill operation enables normally maintaining the freezer compartment at a temperature a few degrees higher than with known refrigerators, which provides an energy savings. After pre-chill, the defrost heater is energized to clear the evaporator coils of ice.

Bimetal switches (sometimes referred to herein as terminators) are electrically connected in series with the defrost heater. The switches are responsive to the heat from the defrost heater after the coils have been cleared of frost and ice. After the control has sensed that the terminators have operated, i.e., opened, the control initiates a dwell.

Dwell is the time period after defrost heat is terminated and before the compressor is allowed to turn back on, i.e., before the cold control re-energizes the compressor. Although dwell time preferably is minimized, sufficient time must be provided to allow the freon pressures to equalize so that the compressor properly operates and to allow water to drip off the evaporator. To minimize dwell time, the termination of defrost heat by the external bimetal switches (i.e., the terminators) is monitored. Once the bimetal switches terminate the heating, dwell time is entered and the control holds the compressor off until the dwell time is ended. Once the defrost sequence is complete, the cold control then re-energizes the compressor while the adaptive control monitors the compressor on time. The adaptive control continues the monitoring function to determine when to reenter the defrost sequence.

If the defrost heater on time, i.e., the time from initiation of defrost operations to opening of the terminators, is longer than expected, the defrost is terminated by the adaptive control. When the control terminates a defrost, e.g., defrost time exceeds a Defrost Heat Time, a defrost relay is opened and the cold control is re-energized. Therefore, after a time terminated defrost, there is no dwell time.

If a defrost operation requires an abnormally long time, as defined by an Abnormal Defrost Delta Time, or has terminated due to a Defrost Heat Time, then the adaptive controller determines a time for a next defrost operation based only on the compressor run time with no door open adaptive features. This next defrost occurs after the compressor has run a fixed compressor run time referred to as an Abnormal Run Time. If a defrost operation is terminated by the Defrost Heat Time, initiation of the next defrost is determined by the Abnormal Run Time.

Also during adaptive run time, there is a minimum time between defrosts to ensure that a failed switch or a door open condition does not cause unnecessary defrost operations. For example, if a refrigerator door is left open, a refrigerator may enter into defrost operations every 2 hours. By requiring that a minimum time must elapse prior to entering defrost, such excessive defrost operations are avoided.

In addition to being adaptive, the control enables immediate entry into a defrost or pre-chill state for product service or test purposes. In an exemplary embodiment, by manually depressing the fresh food light switch a preselected number (e.g., 3) times within a preselected time period (e.g., 5 seconds), an immediate (no pre-chill) defrost is initiated unless the control is already in the defrost or dwell states.

Once in the defrost state, and if the fresh food light switch is depressed a preselected number (e.g., 3) times within a preselected time period (e.g., 5 seconds), then the defrost state is exited. The pre-chill state can be entered by manually depressing the fresh food light switch a different preselected number (e.g., 6) times within the preselected time period (e.g., 5 seconds).

DETAILED DESCRIPTION OF THE INVENTION

An exemplary embodiment of defrost control is described below in detail in connection with a household refrigerator. Such household refrigerators are commercially available, for example, from General Electric Company, Louisville, Ky., 40225, and such refrigerators can be modified to incorporate the defrost control. The defrost control, of course, can be used in many other models and types of refrigerators, and is not limited to any one particular refrigerator type. Also, and although the present invention is described herein in the context of a household refrigerator, the invention can be used in connection with many other types of cooling apparatus in which defrost operations are performed.

Figure 1:
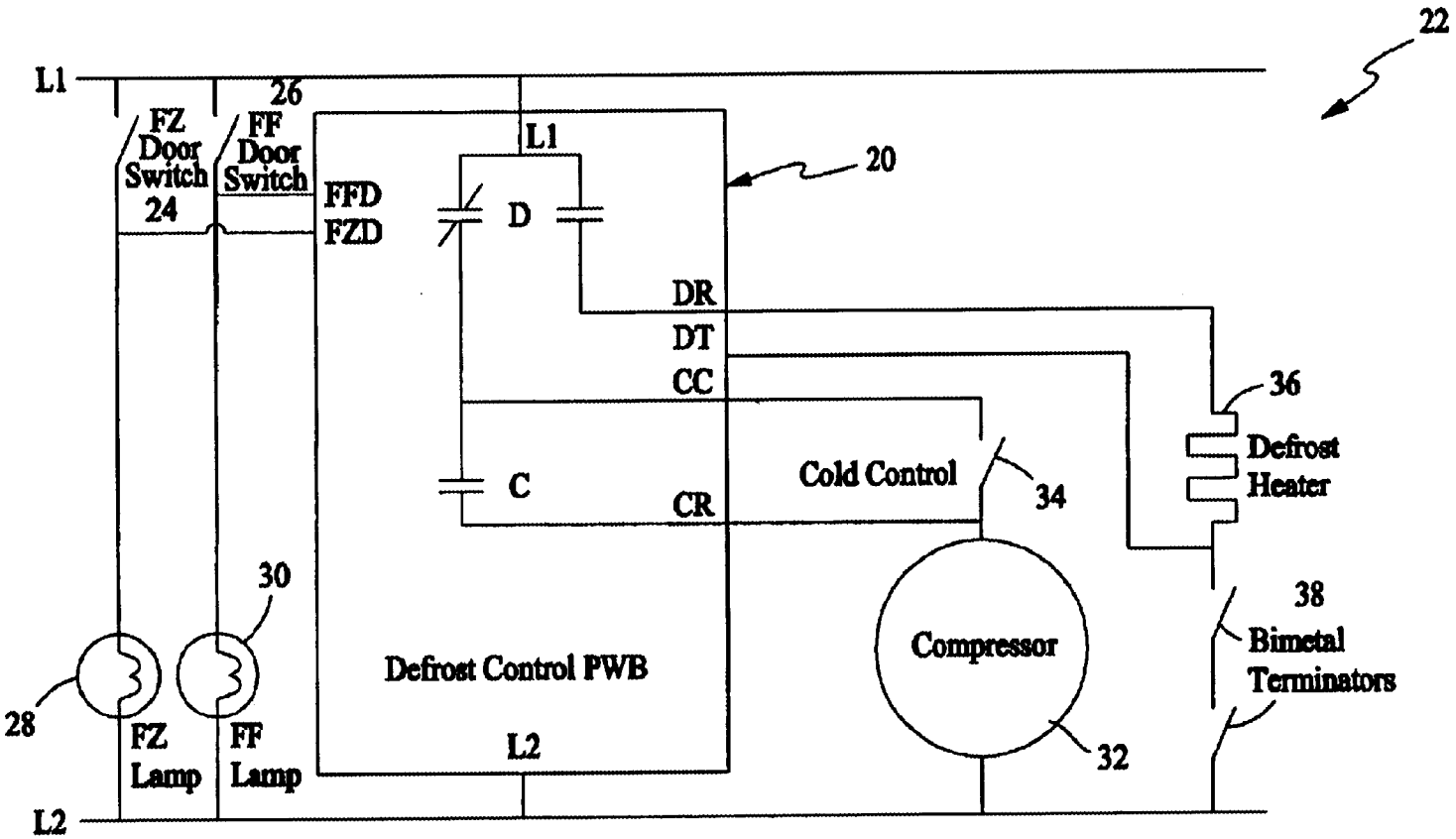
FIG. 1 is a block diagram of a defrost control.

Referring now specifically to the figures, FIG. 1 is a block diagram of a defrost control 20 in accordance with one embodiment of the present invention. Defrost control is electrically coupled to components of a refrigerator 22 to control defrost operation. More particularly, refrigerator 22 includes a freezer door and a fresh food door, and respective switches 24 and 26 generate signals indicative of whether the respective doors are open or closed. A freezer lamp 28 is connected in series with freezer door switch 24, and a fresh food lamp 30 is connected in series with fresh food switch 26 so that when either door is open and the respective switches 24 and 26 close, the appropriate lamp is energized and illuminates the fresh food or freezer compartments. Control 20 is electrically coupled to switches 24 and 26 and receives signals at pins FFD and FZD indicative of the state of each switch.

Refrigerator 22 also includes a compressor 32 connected in series with a cold control switch 34. When refrigerator 22 requires cooling, cold control switch 34 closes so that compressor 32 is energized. Refrigerator 22 also includes a defrost heater 36 and bimetal terminators 38. As described below in more detail, terminators 38 control de-energization of defrost heater 36.

Compressor 32 may, for example, be an induction compressor motor energized by a 230V, 50/60 Hz source, and having a 2.0 A full load current at 230V/50 Hz+/−15%, and a 15 A locked rotor current. Condenser and evaporator fans (not shown) may be shaded pole or ECM fan motors energized at 230V, 50/60 Hz. Defrost heater 36 may be energized as a resistance load at 230V, 50/60 Hz, a 4.5 A rated current, and 10,000 operations in 20 year life.

Figure 2:
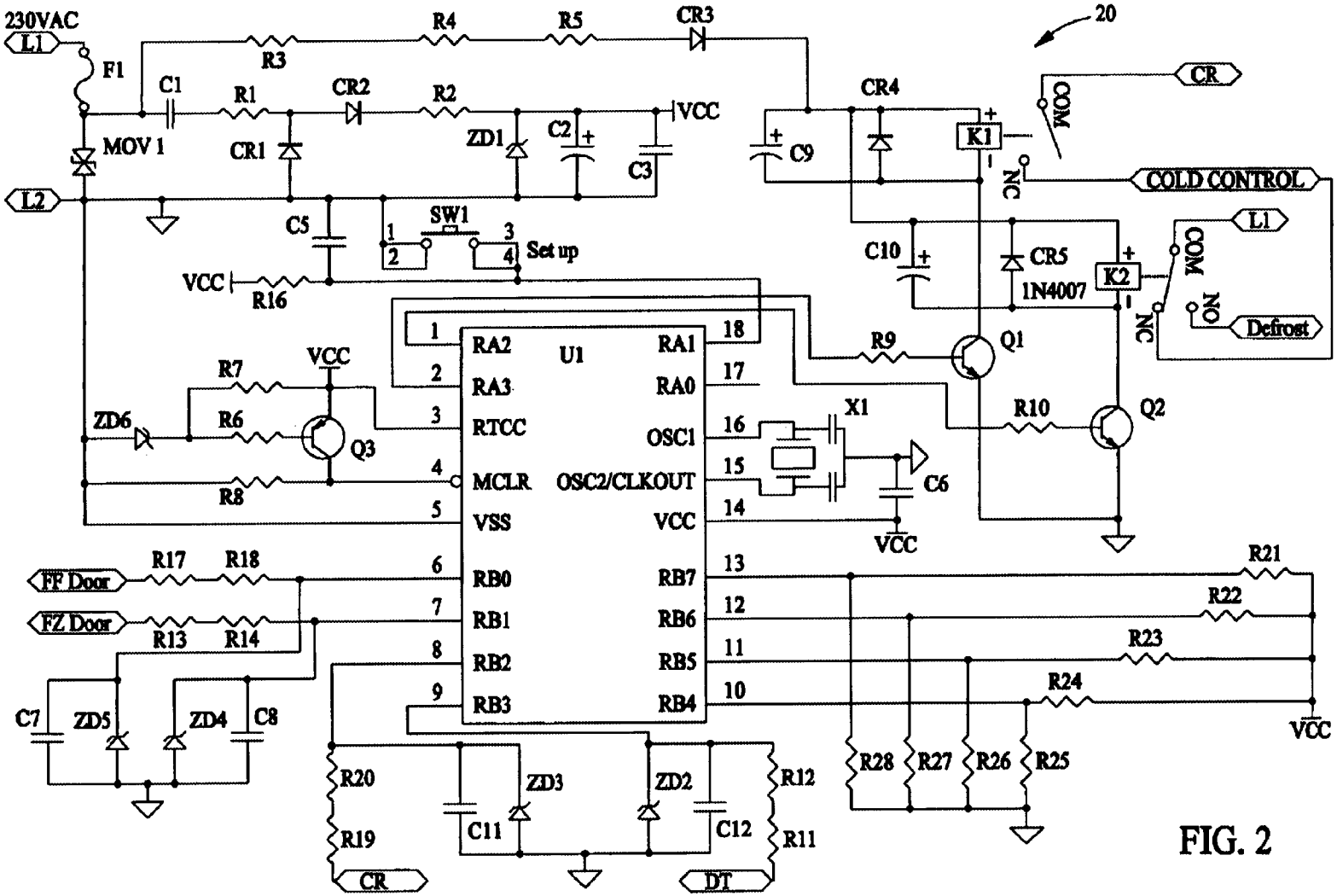
FIG. 2 is a circuit schematic illustration of the defrost control printed wire board shown in FIG. 1.

FIG. 2 is a circuit schematic illustration of defrost control 20 implanted on a printed wire board and configured for controlling refrigerator defrost operations. Generally, control 20 includes a microcontroller 40, sometimes referred to herein as a microcomputer or processor, U1 which controls relays K1 and K2. Relays K1 and K2 control energization of compressor 32 and defrost heater 36. Exemplary values for the components of control 20 are set forth below.

| | |
|---|---|
| Capacitors | |
| C1: | 0.18 uF/400 V |
| C2: | 2200 uF/16 V |
| C3: | 0.1 uF |
| C4: | 0.01 uF |
| C5: | 0.1 uF |
| C6 | 0.1 uF |
| C7: | 0.01 uF |
| C8: | 0,01 uF |
| C9: | 22 uF/250 V |
| C10: | 22 uF/250 V |
| C11: | 0.01 uF |
| C12: | 0.01 uF |
| Resistors | |
| R1 | 39K, 1/2 W |
| R2: | 470 |
| R3: | 3K, 3 W |
| R4: | 3K, 3 W |
| R5: | 220, 1/2 W |
| R6: | 10K |
| R7: | 33K |
| R8: | 33K |
| R9: | 4.7K |
| R10: | 4.7K |
| R11: | 470K, 1/2 W |
| R12: | 470K, 1/2 W |
| R13: | 470K, 1/2 W |
| R14: | 470K, 1/2 W |
| R16: | 10K |
| R17: | 470K, 1/2 W |
| R18: | 470K, 1/2 W |
| R19: | 470K, 1/2 W |
| R20: | 470K, 1/2 W |
| R21: | 10K |
| R22: | 10K |
| R23: | 10K |
| R24: | 10K |
| R25: | 10K |
| R26: | 10K |
| R27: | 10K |
| R28: | 10K |

-continued

| | |
|---|---|
| Diodes | |
| CR1: | 1N4007 |
| CR2: | 1N4007 |
| CR3: | 1N4007 |
| CR4: | 1N4007 |
| CR5: | 1N4007 |
| Zener Diodes | |
| ZD1 | 1N5231 |
| ZD2: | 1N5231 |
| ZD3: | 1N5231 |
| ZD4: | 1N5231 |
| ZD5: | 1N5231 |
| ZD6: | 1.8V, 1N4678 |
| Transistors | |
| Q1: | MPS0A44 |
| Q2: | MPS-A44 |
| Q3: | MMBT-4403 |
| Transformers | |
| X1: | 4 MHz |
| Metal Oxide Varistor | |
| MOV1: | 300 V MOV |
| Fuse Link | |
| F1 | |
| Relays | |
| K1: | Relay-24 V, 15 Amp/275 V |
| K2: | Relay-24 V, 15 Amp/275 V |
| Processor | |
| U1: | PIC16C54/XT |

The present invention is not limited to implementation with the specific components described above, and many variations are possible.

Figure 3:
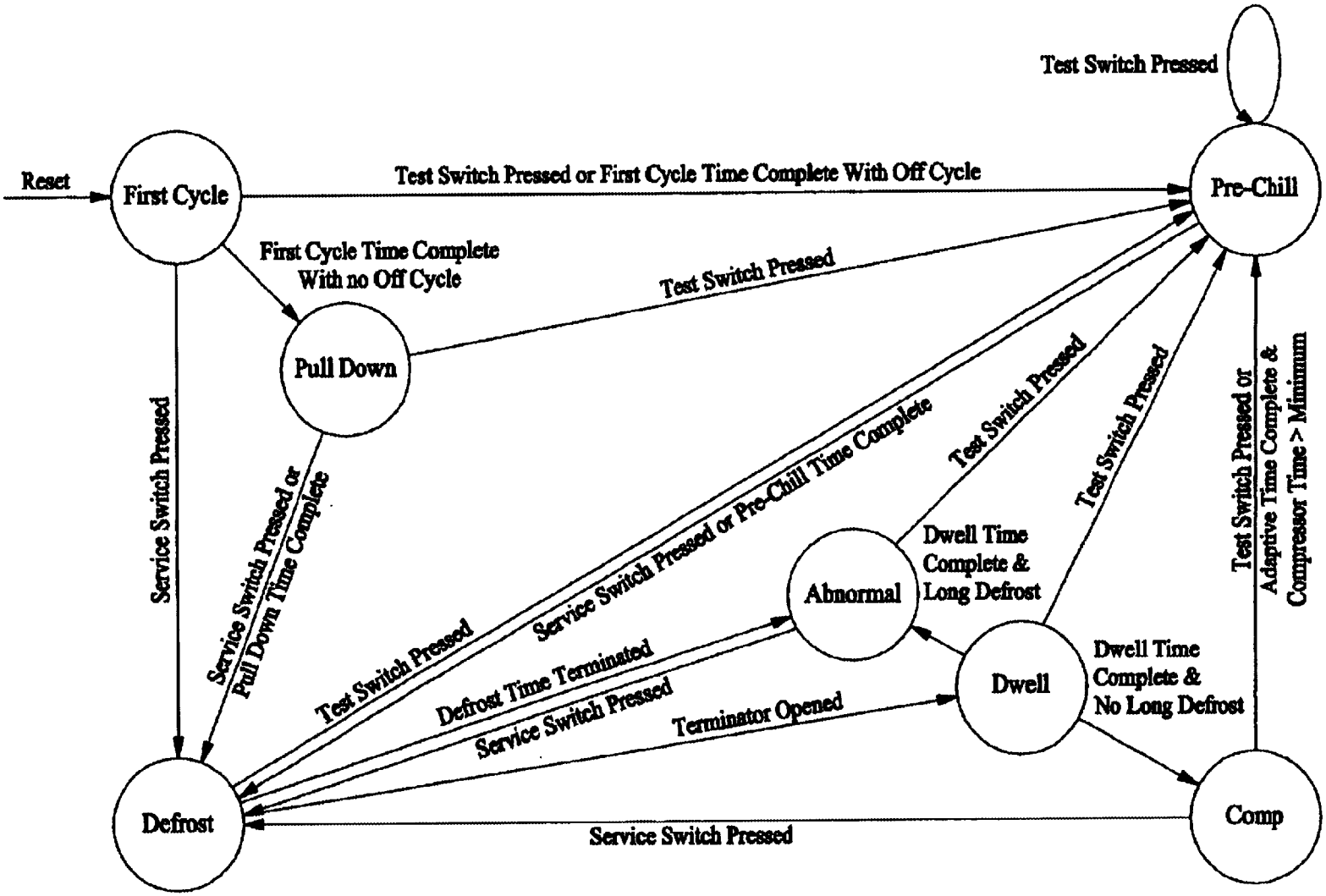
FIG. 3 is a state diagram showing the expected states of this control.
Figure 4:
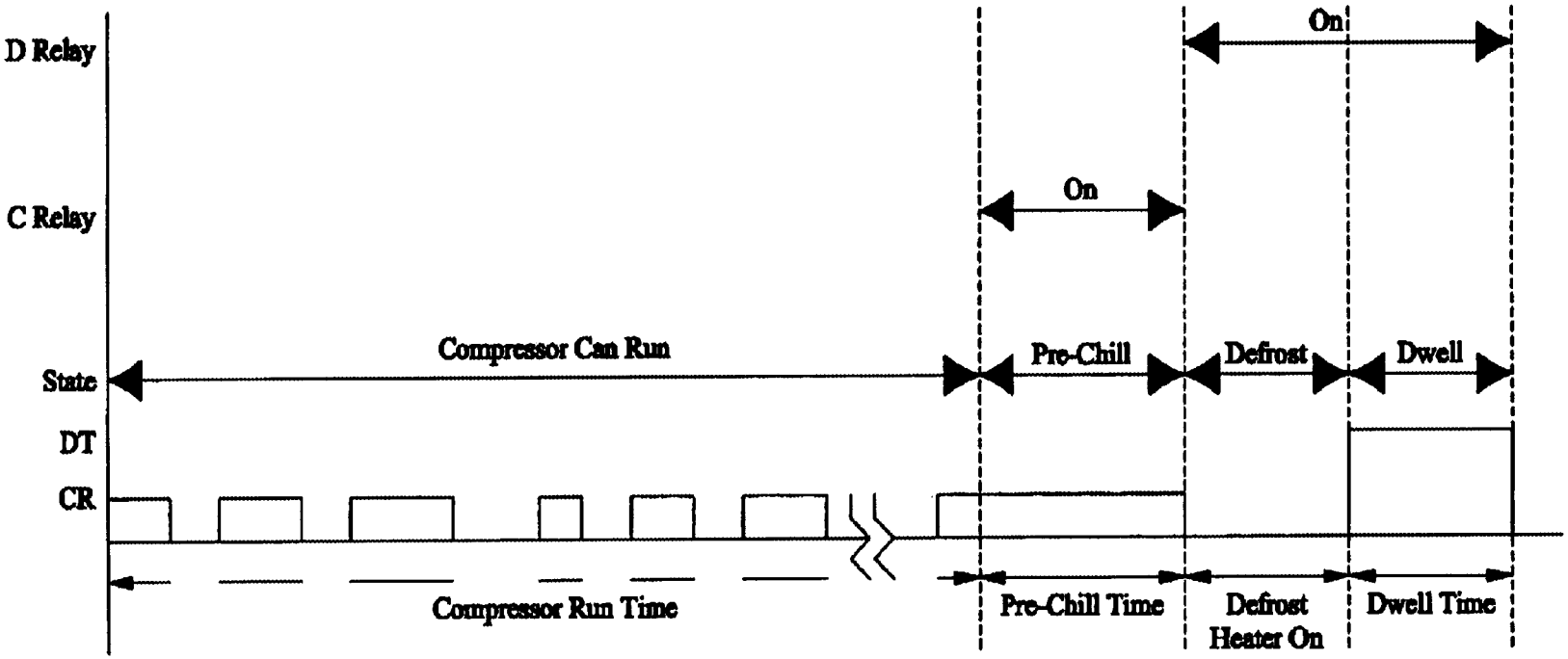
FIG. 4 is a timing diagram representing typical operation.

FIG. 3 is a state diagram showing the expected states of control 20, and FIG. 4 is a timing diagram illustrating the timing associated with each state. Each state, and the associated timing, are described below.

Compressor State

In this state, compressor 32 is controlled by cold control 34. Defrost control 20 sums the compressor run time by monitoring the compressor voltage at pin CR (FIG. 1). Defrost control 20 also monitors the Fresh Food and Freezer door open times and reduces the compressor run time by a factor multiplied by the door open times.

Pre-Chill State

Compressor 32 is controlled by C relay (FIG. 1). C relay is on during the Pre-Chill Time period. No adaptive inputs affect the timing during Pre-Chill.

Defrost State

Compressor 32 is held off and defrost heater 36 is turned on by operating D relay (FIG. 1). During this time, control 20 monitors defrost terminator 38 to determine when terminators 38 open. If terminators 38 open during the defrost time, heater 36 is turned off and control 20 immediately enters the dwell state. If terminator 38 do not open during the defrost time, defrost operation is terminated by time and the dwell state is bypassed. No adaptive inputs affect the Defrost timing.

Dwell State

During the Dwell time, relay D (FIG. 1) is energized and maintains compressor 32 off. No adaptive inputs affect the Dwell timing.

First Cycle State

After a power failure, control 20 monitors the compressor run time. If control 20 determines that compressor 32 has turned off during the Normal Power Up Time period, control 20 enters the Pre-Chill state and a normal defrost condition. If control 20 determines that compressor 32 has not turned off during the Normal Power Up Time, control 39 enters the Pull Down state.

Pull Down State

In the Pull Down state, control 20 monitors the compressor run time for the Pull Down Time and immediately enters defrost operation without a pre-chill at the end of the Pull Down Time.

Abnormal State

The Abnormal state is entered when the defrost time has been longer than the abnormal defrost time as defined by Abnormal Defrost Delta Time, and/or when the defrost state is time terminated. When in the Abnormal state, control 20 enters the next defrost operation after a fixed amount of compressor run time, referred to herein as the Abnormal Run Time.

To achieve the state control and timing described above, control 20 operates in accordance with the process steps illustrated in FIGS. 5–12. The flow charts set forth in FIGS. 5–12 are provided to set forth a general overview of the operation of microcontroller 40. A flow chart illustrating one possible microcontroller firmware implementation is set forth in FIG. 13.

Figures 5A, 5B:
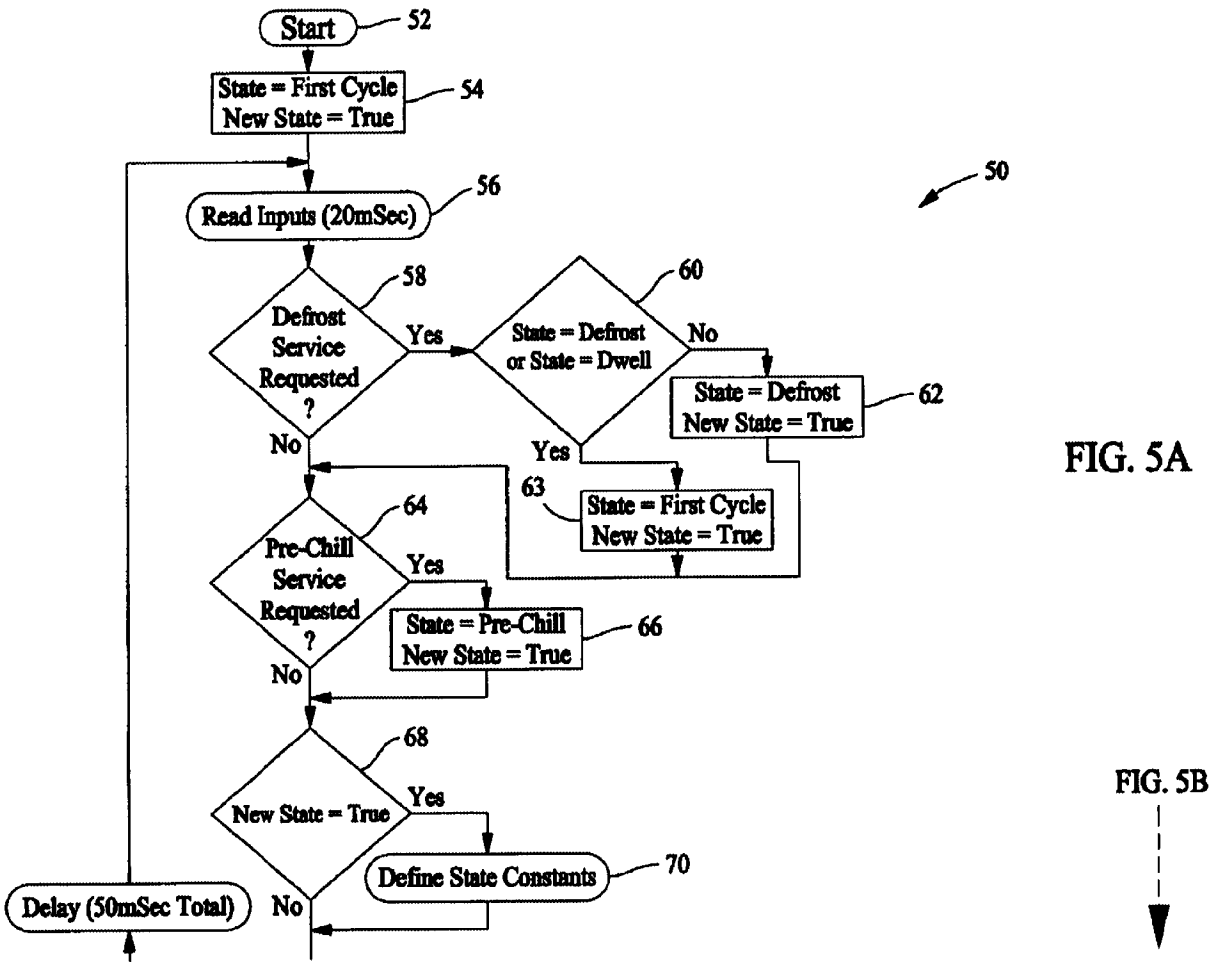
FIG. 5 (FIGS. 5A and 5B collectively) is a flow chart illustrating a sequence of process steps executed by the microprocessor of the defrost control board.
Figures 5A, 5B:
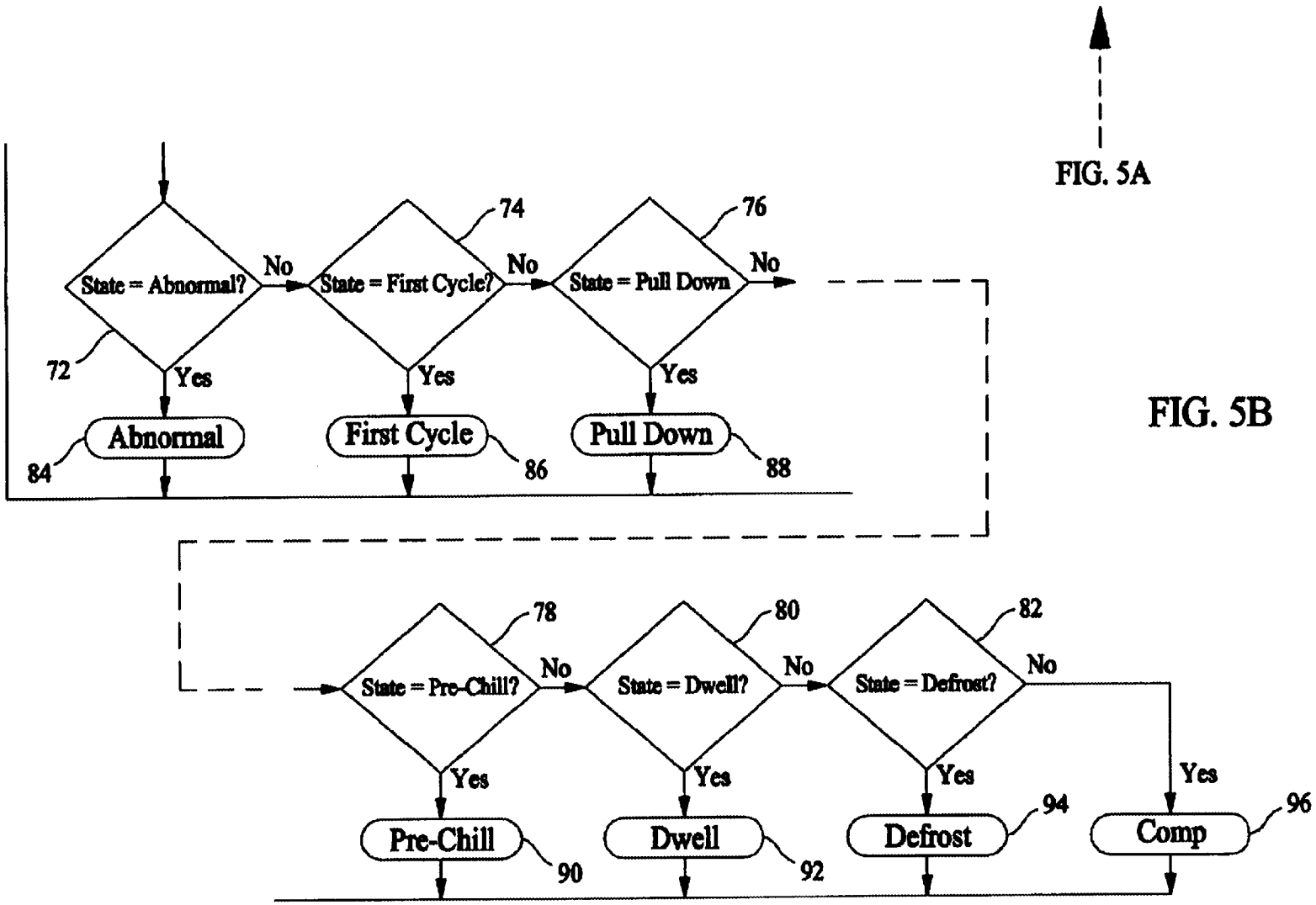

More specifically, FIG. 5 illustrates process steps 50 executed by controller 40 upon initiation, or start 52, of operation, i.e., power-up. Upon power up 52, controller 40 may execute factory tests (not shown). These tests may be useful in both the factory and in the field in the event that a problem has been detected. In any event, after power up, controller 40 sets State equal to First Cycle and New State equal to True 54. Controller 40 then reads 56 inputs, e.g., FFD, FZD, CR and DT, which takes about 20 msec, and determines whether the defrost service has been requested, e.g., one press of switch S1, 58. If yes, controller 40 checks whether the State equals Defrost or State equals Dwell 60. If no, then controller 40 sets State equal to Defrost and New State equal to True 62. If yes, then controller 40 sets State equal to First Cycle and New State equal to True 63.

After completing steps 60–63, or if the defrost service was not requested, controller 40 checks whether pre-chill service has been requested 64, e.g., two presses of switch S1. If yes, then State is set equal to Pre-Chill and New State is set equal to True 66.

As an alternative to switch SW1, an existing switch in the refrigerator may be used, e.g., the fresh food compartment light switch, to request defrost service and pre-chill service. For example, by manually depressing the fresh food light switch a preselected number (e.g., 3) times within a preselected time period (e.g., 5 seconds), an immediate (no pre-chill) defrost is initiated unless the control is already in the defrost or dwell states. Once in the defrost state, and if the fresh food light switch is depressed a preselected number (e.g., 3) times within a preselected time period (e.g., 5 seconds), then the defrost state is exited. The pre-chill state can be entered by manually depressing the fresh food light switch a different preselected number (e.g., 6) times within the preselected time period (e.g., 5 seconds). Of course, many other variations are possible.

Referring again to FIG. 5, and after completing step 66, or if pre-chill service is not requested, then controller 40 determines whether New State is equal to True 68. If yes, then state constraint are defined 66. After defining state constraints, or if New State is not equal to True, then controller 40 determines whether the current state equals Abnormal 72, First Cycle 74, Pull Down 76, Pre-Chill 78, Dwell 80, or Defrost 82. Depending upon the current state, controller 40 then executes Abnormal 84, First Cycle 86, Pull Down 88, Pre-Chill 90, Dwell 92, or Defrost 94 subroutines. If the state is not one of the identified states, then controller 40 executes a compressor 96 subroutine. Subsequent to executing the appropriate subroutine, then processor delays processing for about 50 msec. and returns to step 56.

Figure 6:
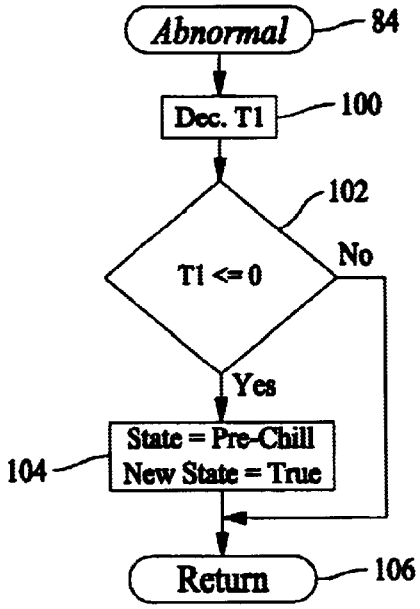
FIG. 6 is a flow chart illustrating the sequence of process steps for the abnormal subroutine referenced in FIG. 5.

Set forth below is a description of each subroutine. More particularly, FIG. 6 is a flow chart illustrating the sequence of process steps for the abnormal subroutine 84 referenced in FIG. 5. Generally, abnormal defrost control provides a faster defrost if the last defrost continued in the heating stage for a greater time than expected. By defrosting sooner, it is expected that any icing condition would clear up.

Specifically, if the defrost requires an abnormally long time, defined by the Abnormal Defrost Delta Time, or has terminated due to the Defrost Heat Time, then the next defrost is controlled by the compressor run time only with no door open adaptive features. The next defrost occurs after compressor has run a fixed compressor run time referred to herein as the Abnormal Run Time. The abnormal defrost time is less than the Defrost Heat Time. Therefore, if defrost is terminated by the Defrost Heat Time, the next defrost is determined by the Abnormal Run Time. Since the abnormal defrost time is limited by the Defrost Heat Time and since there are jumpers which change the Defrost Heat Time as described below in more detail, the Abnormal Defrost Delta Time is defined as the Defrost Heat Time minus the abnormal defrost time. Thus, the Abnormal Defrost Delta Time defines the time left in a Defrost Heat Time at which a flag is set which will later initiate an Abnormal Run Time instead of a normal adaptive condition.

Specifically referring now to FIG. 6, in the abnormal state, controller 40 decrements a counter T1 100, and if T1 is less than or equal to zero 102, then controller 40 sets State equal to Pre-Chill and New State equal to true 104. If T1 is greater than zero, or after controller 40 sets State and New State, controller 40 returns 106 back to main routine 50 illustrated in FIG. 5.

Figure 7:
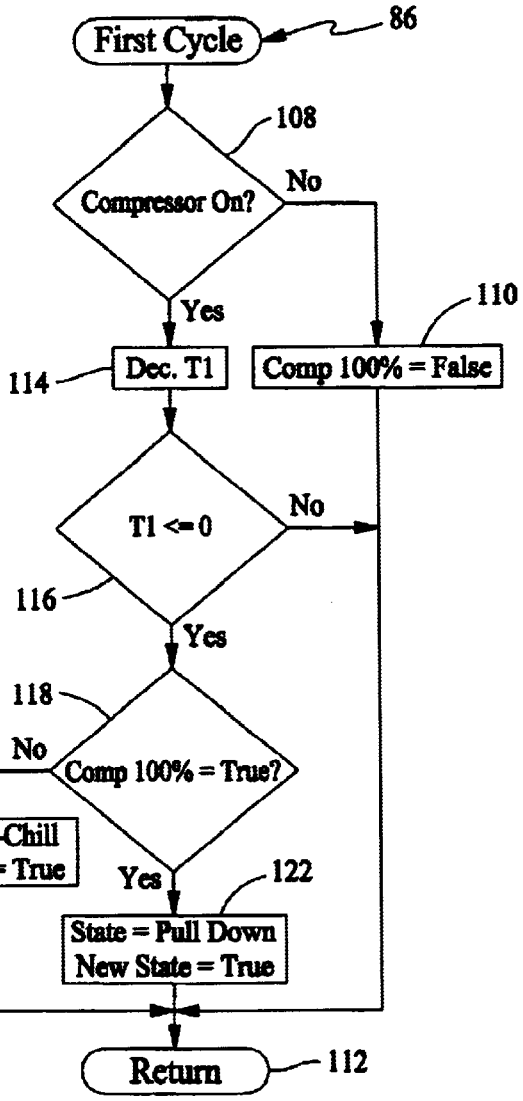
FIG. 7 is a flow chart illustrating the sequence of process steps for the first cycle subroutine referenced in FIG. 5.

FIG. 7 is a flow chart illustrating the sequence of process steps for the first cycle subroutine 108 referenced in FIG. 5. More particularly, first cycle defrost control facilitates ensuring that if the refrigerator is warm, a sufficient time is provided to pull down the compartment temperatures before a defrost occurs, and also provides for an early defrost if the refrigerator is already cold.

Since no knowledge about the last defrost is carried through a power failure of more than, for example, 1.4 seconds, a special power up sequence is provided. Specifically, after power is reapplied from a power failure, the compressor continuous on time is monitored. If the compressor turns on (almost immediately) and remains continuously on for a time equal to Normal Power Up Time, then the refrigerator is assumed to be in a pull down condition and a defrost is delayed until the Pull Down Time has elapsed. Otherwise, if the compressor shuts down before the Normal Power Up Time, then it is assumed that the refrigerator is already cold and that a defrost could be needed. Therefore, a defrost sequence is initiated at the Normal Power Up Time. The Pull Down Time and Normal Power Up Time may be different for different controls.

More specifically referring to FIG. 7, and with respect to achieving the above described control, in first cycle subroutine 86 controller 40 checks whether the compressor is on 108. If no, then Compressor 100% is set equal to false 110, and processing returns 112 back to main routine 50. If yes, timer Ti is decremented 114 and controller 40 checks whether timer T1 has a value less than or equal to zero 116. If no, then processing 112 returns to main routine 50. If yes, then controller 40 determines whether Compressor 100% is set equal to true 118. If no, the State is set equal to Pre-Chill and New State is set equal to True 120. If yes, then controller 40 sets State equal to Pull Down and New State equal to True 122. Processing then returns to the main routine 50.

Figure 8:
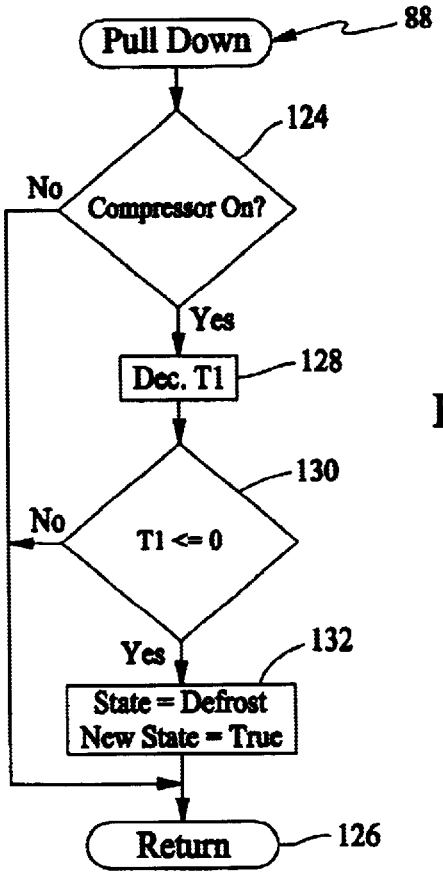
FIG. 8 is a flow chart illustrating the sequence of process steps for the pull down subroutine referenced in FIG. 5.

FIG. 8 is a flow chart illustrating the sequence of process steps for pull down subroutine 88 referenced in FIG. 5. More particularly, and as with first cycle defrost control, pull down control facilitates ensuring that if the refrigerator is warm, a sufficient time to pull down of the compartment temperatures is provided before a defrost occurs, and also provides for an early defrost if the refrigerator is already cold.

More specifically referring to FIG. 8, and with respect to achieving the above described control, in Pull Down subroutine 88, controller 40 checks whether compressor is on 124. If no, then processing returns 126 back to main routine 50. If yes, then timer T1 is decremented 128 and controller 40 checks whether timer T1 has a value less than or equal to zero 130. If no, then processing returns 126 to the main routine 50. If yes, then controller 40 sets State equal to Defrost and New State is set equal to True 132. Processing then returns 126 to main routine 50.

Figure 9:
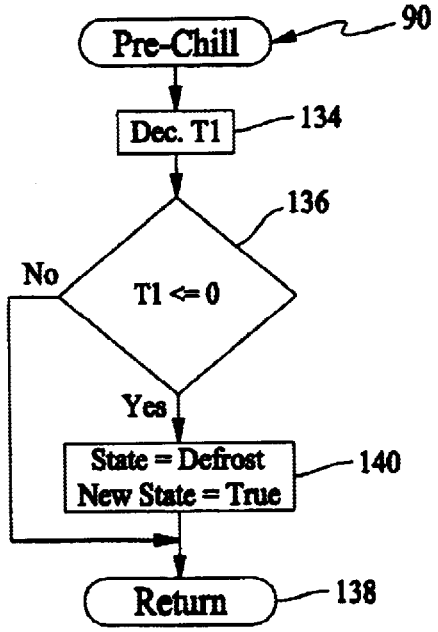
FIG. 9 is a flow chart illustrating the sequence of process steps for the pre-chill subroutine referenced in FIG. 5.

FIG. 9 is a flow chart illustrating the sequence of process steps for pre-chill subroutine 90 referenced in FIG. 5. More specifically, pre-chill control provides for cooling the freezer compartment prior to a defrost to decrease the potential for the food to warm too much during a defrost operation. That is, pre-chill is intended to cool the freezer prior to applying heat to the evaporator coil so that the defrost heat will have less of an effect on the food temperature and on the maximum temperature after defrost. Therefore, when the control has determined that a defrost should be initiated, the heating portion of a defrost will be preceded by a Pre-Chill Time when the compressor is held on without regard to the cold control demand for cooling. Pre-Chill Time may be different for different controls.

Referring specifically to FIG. 9, once Pre-Chill operations 90 are initiated, controller 40 decrements the value of timer T1 134. Controller 40 then checks whether timer T1 has a value less than or equal to zero 136. If no, the processing returns 138 to main routine 50. If yes, then controller 40 sets State equal to Defrost and New State equal to true 140. Processing then returns 135 to main routine 50.

Figures 10, 11:
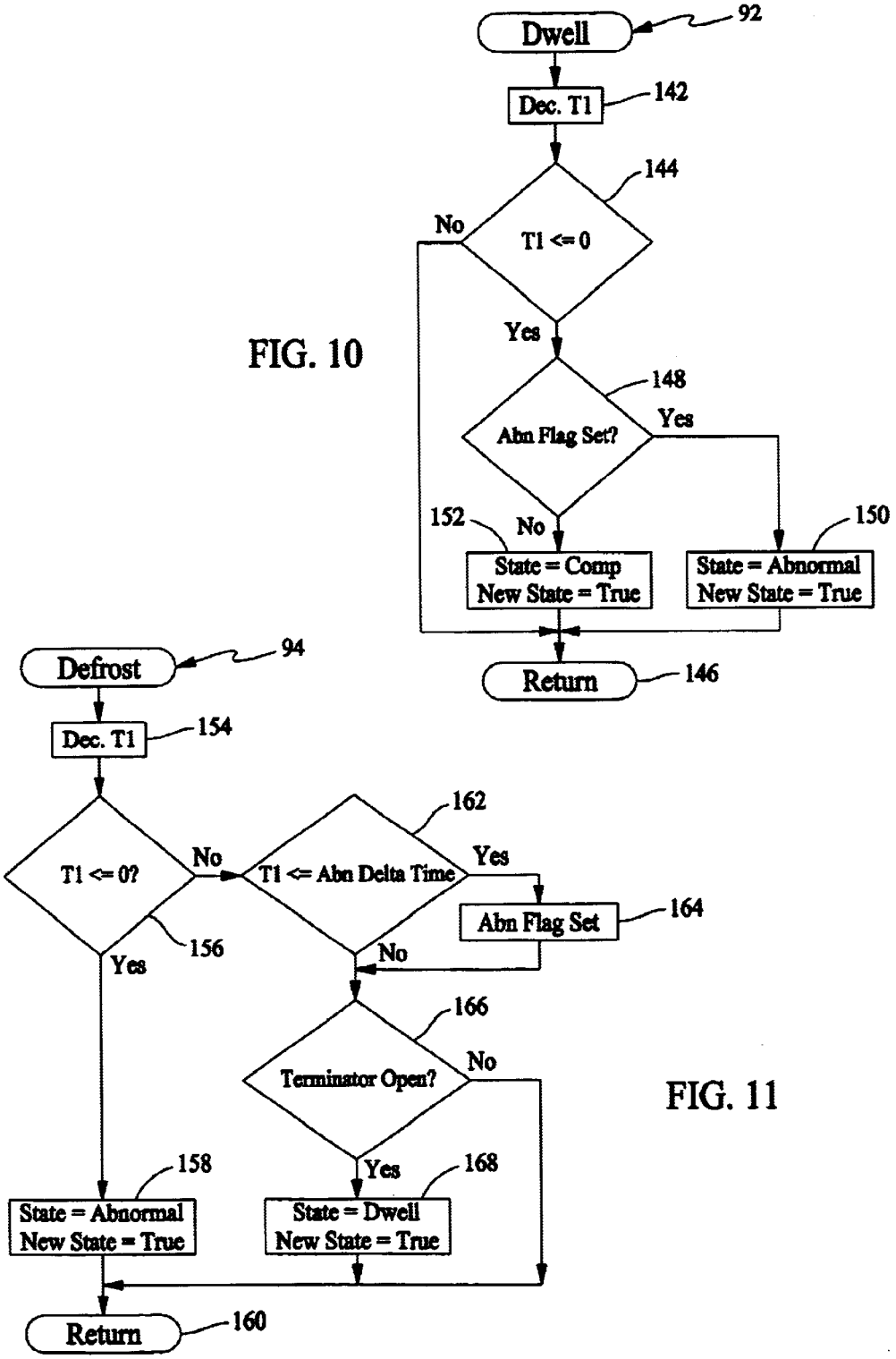
FIG. 10 is a flow chart illustrating the sequence of process steps for the dwell subroutine referenced in FIG. 5.
FIG. 11 is a flow chart illustrating the sequence of process steps for the defrost subroutine referenced in FIG. 5.

FIG. 10 is a flow chart illustrating the sequence of process steps for dwell subroutine 92 referenced in FIG. 5. More particularly, fixed time dwell control controls the elapsed time after a heated defrost prior to re-energizing the compressor. The Dwell state is as short as possible to reduce food heating but must allow the freon to equalize so that the compressor properly operates.

The intent of the Dwell state is to minimize the dwell time as compared to known controls. Therefore, the termination of defrost heat by the bimetal switches is monitored. As soon as the bimetal switches terminate the heating step of defrost, a Dwell time is entered which holds compressor off until the Dwell time is ended. Dwell Time may be different for different controls.

Referring now specifically to FIG. 10, once Dwell operations 92 are initiated, controller 40 decrements the value of timer T1 142. Controller 40 then checks whether the value of timer T1 is less than or equal to zero 144. If no, then processing returns 146 to main routine 50. If yes, then controller 40 checks whether the abnormal flag has been set 148. If yes, then controller 40 sets State equal to Abnormal and New State is set equal to True 150. If no, controller 40 sets State equal to Compressor and New State equal to True 152. Processing then returns 146 to main routine 50.

FIG. 11 is a flow chart illustrating the sequence of process steps for defrost subroutine 94 referenced in FIG. 5. The defrost state initiates a defrost which cleans the evaporator coils and keeps them free from frost build up.

During normal defrost operations, the following operations are performed.

1) Pre-chill for a fixed amount of time,

2) Heated defrost terminated by temperature, and

3) Dwell for a fixed amount of time.

During abnormal defrost operations, the following operations are performed.

1) Pre-chill for a fixed amount of time, and

2) Heated defrost terminated after a fixed amount of time.

When the defrost sequence is complete, controller 40 allows the cold control to operate the compressor while monitoring the compressor on time, and other factors for an adaptive defrost control, to determine when to reenter the defrost sequence.

Defrost heater 36 is turned off by bimetal switches 38 which are located at the top of the evaporator. Switches 38 sense heat from defrost heater 36 after the coils have cleared of frost and ice. After controller 40 has senses that terminators 38 have operated, a dwell is initiated.

The defrost head may in some cases last longer than expected. In the case when the defrost heat has lasted longer than the Defrost Heat time, the defrost heat is terminated by controller 40. When controller 40 terminates a defrost, it opens the defrost relay which reenergizes the cold control. Therefore, after a time terminated defrost, there will be no dwell time. Defrost Heat Time may be different for different controls.

Referring now specifically to FIG. 11, once Defrost operations 94 are initiated, controller 40 decrements the value of timer T1 154. Controller 40 then checks whether the value of timer T1 is less than or equal to zero 156. If yes, then controller 40 sets State equal to Abnormal and New State equal to True 158, and processing returns 160 to main routine 50. If no, then controller 40 checks whether timer T1 has a value less than or equal to the Abnormal Delta Time 162. If yes, then the abnormal flag is set 164. If no, or after setting the abnormal flag, controller 40 determines whether the terminator is open 166. If no, processing returns 160 to main routine 50. If yes, then State is set equal to Dwell and the New State is set equal to True 168. Processing then returns 160 to main routine 50.

Figure 12:
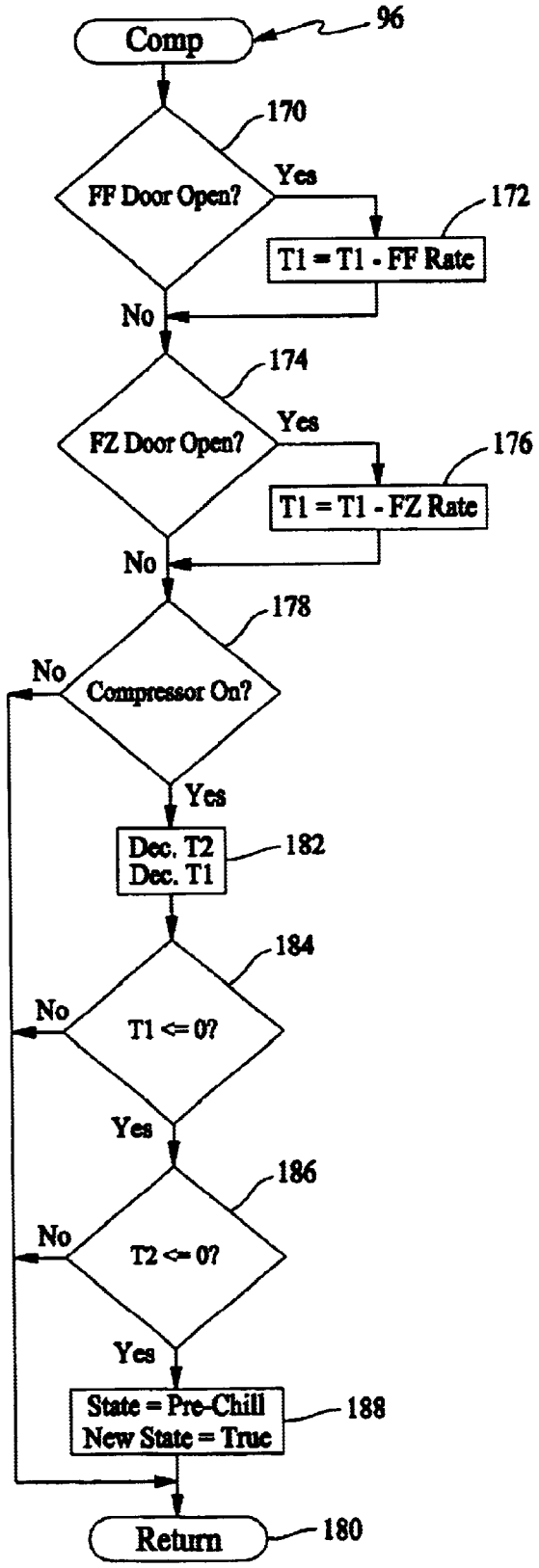
FIG. 12 is a flow chart illustrating the sequence of process steps for the compressor subroutine referenced in FIG. 5.
Figure 13A:
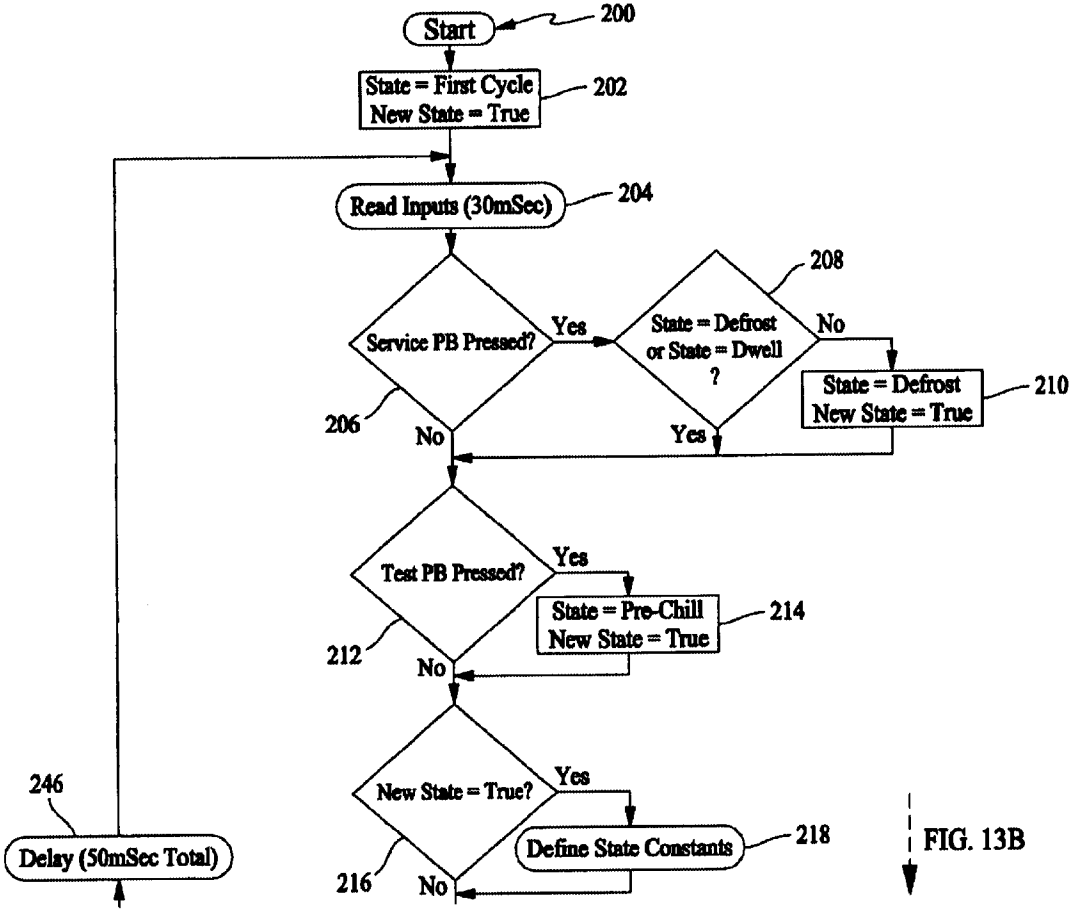
FIG. 13 (FIGS. 13A through 13E collectively) is a flow chart illustrating the sequence of process steps which may be implemented in firmware of the of the control board microcontroller.
Figure 13B:
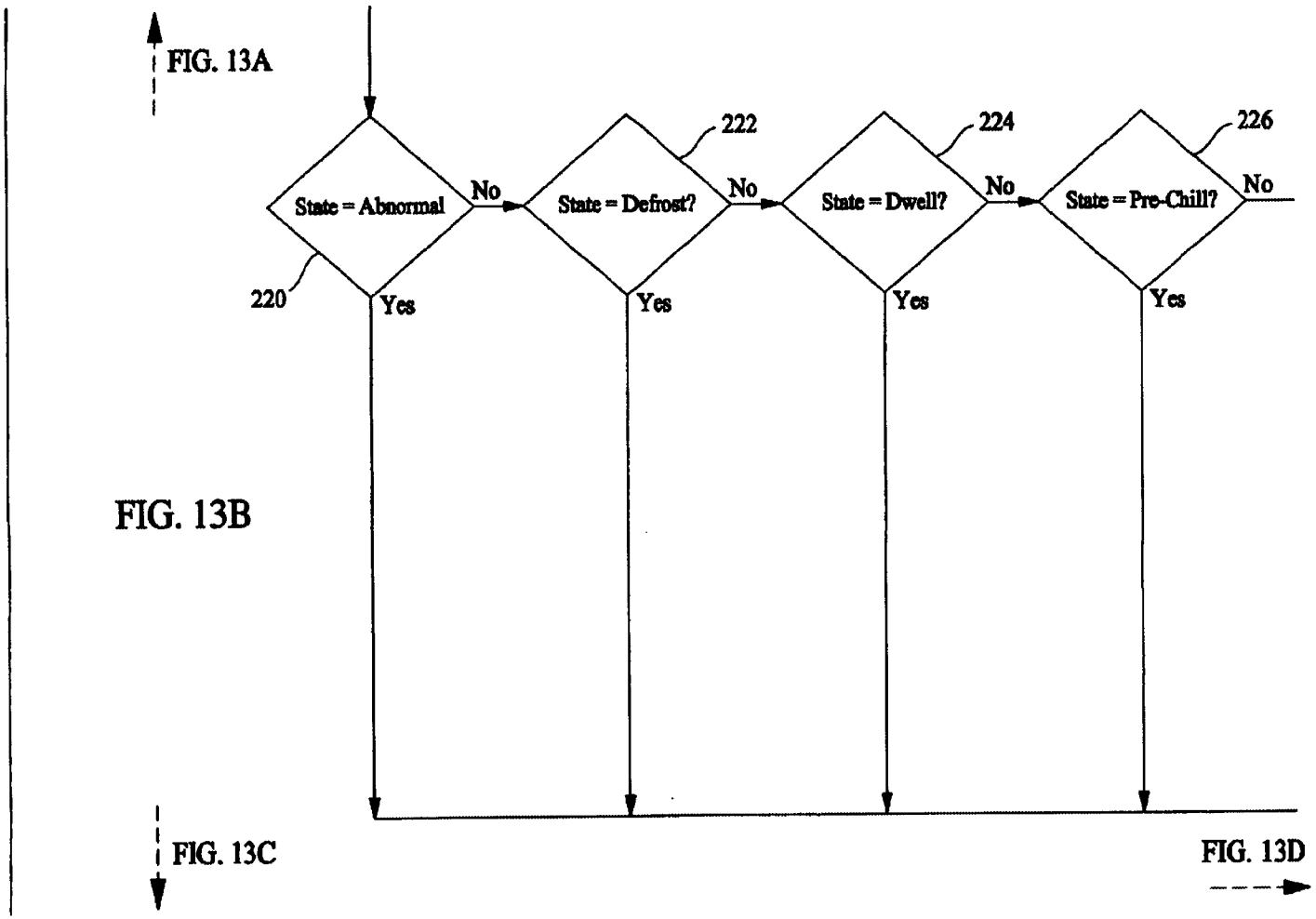
Figure 13C:
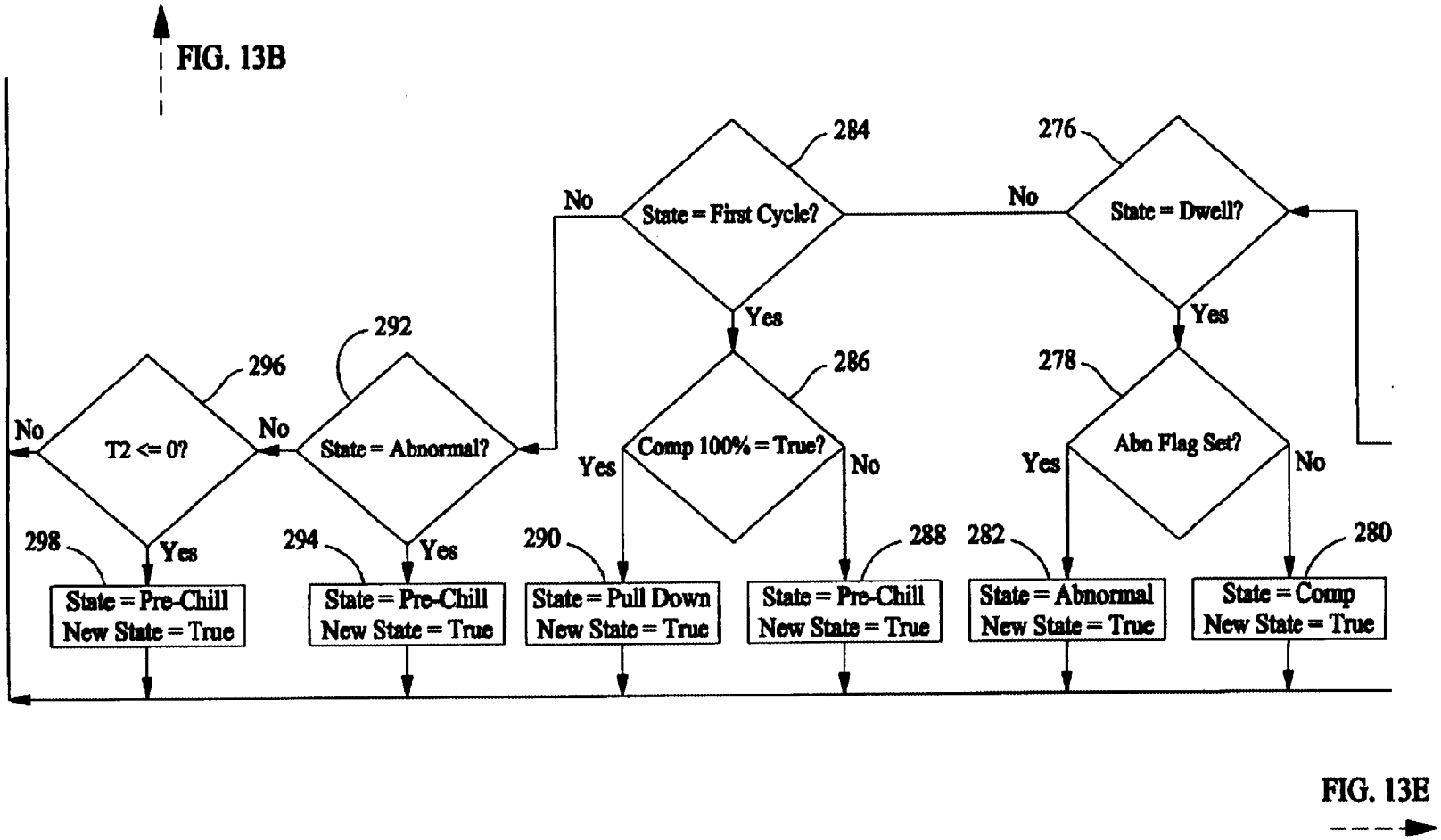
Figure 13D:
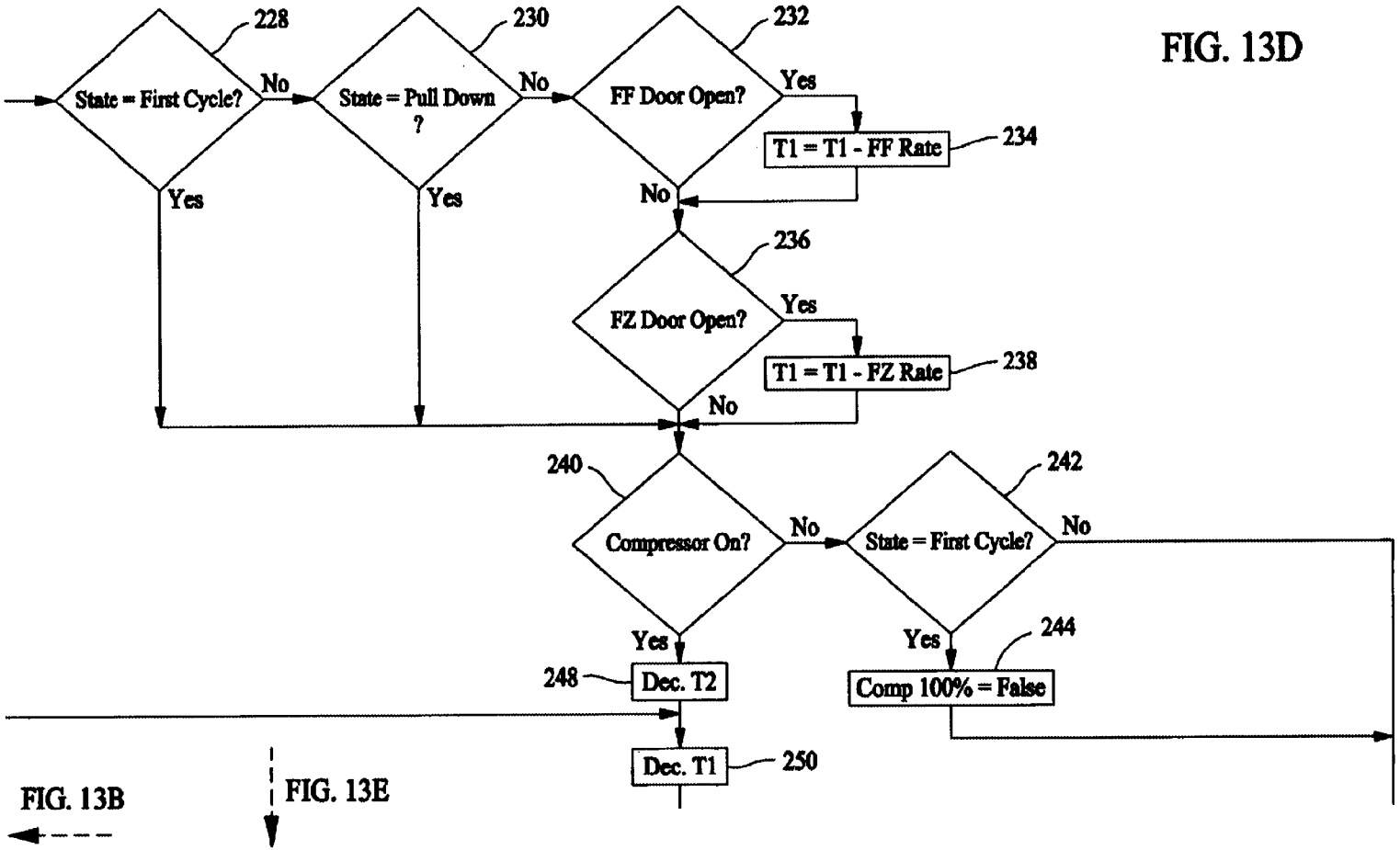
Figure 13E:
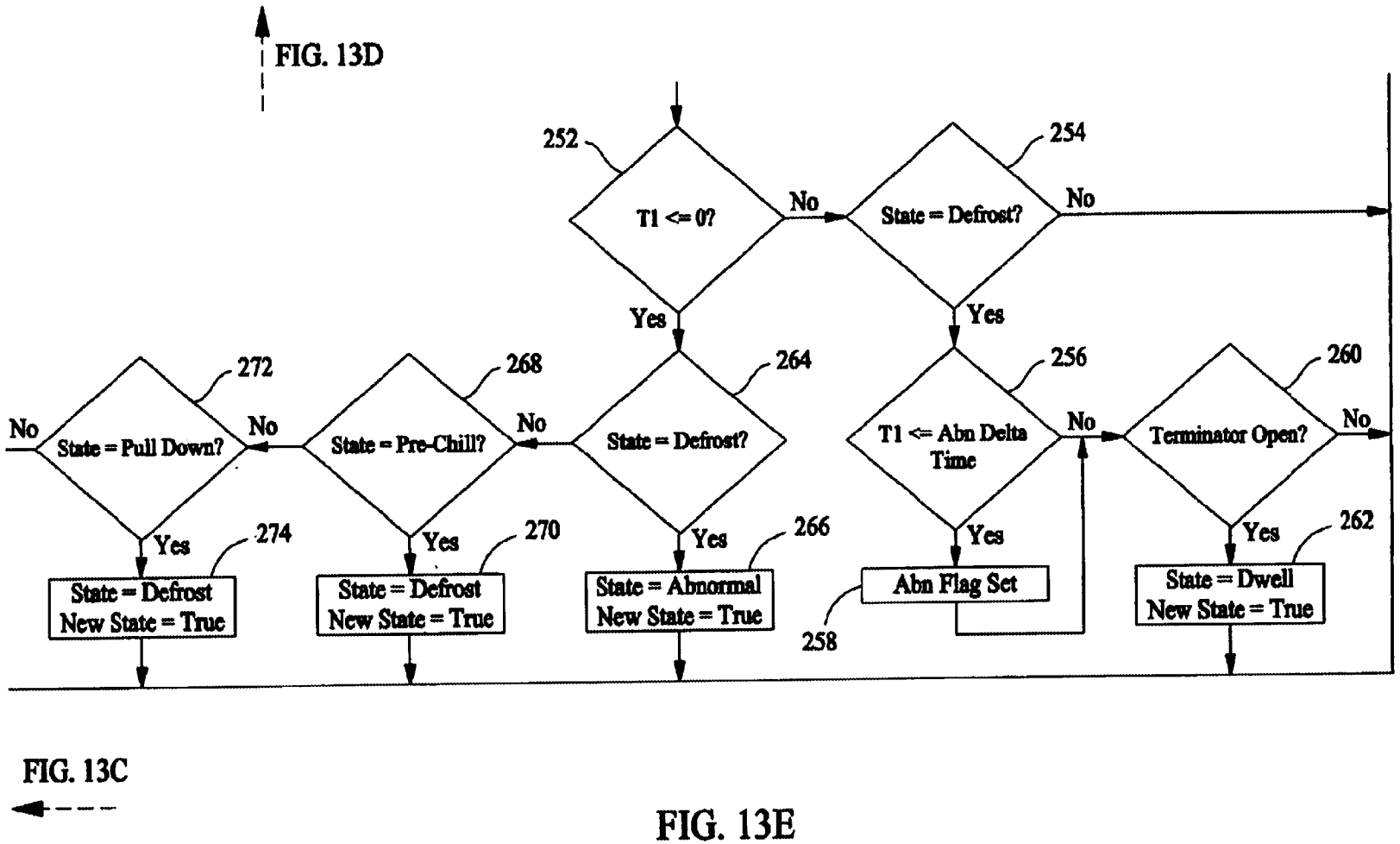

FIG. 12 is a flow chart illustrating the sequence of process steps for compressor subroutine 96referenced in FIG. 5. Generally, controller 40 adapts the defrost time depending upon the door open time of both the fresh food and freezer. This adaptive defrost control is implemented by monitoring both the compressor run time and the fresh food and freezer door open times. More specifically, a timer counts toward the Maximum Time Till Defrost, and this count is the sum of:

compressor run time, fresh food door open time (i.e., the Fresh Food Rate), and freezer door open time (i.e., the Freezer Rate).

Referring now more specifically to FIG. 12, controller 40 checks whether the fresh food door is open 170, and if yes, then timer T1 is set to equal T1-FF Rate 172. After setting timer T1, or if the fresh food door is not open, controller 40 checks whether the freezer door is open 174. If yes, then timer T1 is set to equal T1-FZ rate 176, and after setting timer T1, or if the freezer door is not open, controller 40 determines whether the compressor is on 178. If no, processing returns 180 to main routine 50.

If yes, then timers T2 and T1 are decremented 182, and controller 40 checks whether timer T1 has a value less than or equal to zero 184. If no, processing returns 180 to main routine 50. If yes, then controller 40 checks whether timer T2 has a value less than or equal to zero 186. If no, processing returns 180 to main routine 50. If yes, then State is set to equal Pre-Chill and New State is set to equal True 188. Processing then returns 180 to main routine 50.

The value of timer T1 is the minimum time until a defrost operation is initiated. The value of timer T2 is the maximum time until a defrost operation is initiated. The minimum time between defrosts ensures, for example, that a failed switch or a door open condition does not cause unnecessary defrost operations. For example, if a refrigerator door is left open, a refrigerator may enter into defrost operations every 2 hours. By requiring that a minimum time must elapse prior to entering defrost, such excessive defrost operations are avoided.

FIG. 13 is a flow chart illustrating the sequence of process steps which may be implemented in firmware of the control board microcontroller 40. More specifically, and after initiating, or starting operations 200, controller 40 sets State equal to First Cycle and New State equal to True 202. Then, controller 40 reads 204 inputs, e.g., FFD, FZD, CR, and DT, which takes about 30 msec. Controller 40 then determines whether the service press button 206 has been pressed, e.g., one press of switch S1, and if yes, checks whether the State equals Defrost or State equals Dwell 208. If no, then controller 40 sets State equal to Defrost and New State equal to True 210.

After completing steps 208-210, or if the service press button was not pressed, controller checks whether the test press button 212 has been pressed, e.g., two presses of switch S1. If yes, then State is set equal to Pre-Chill and New State is set equal to True 214.

After completing steps 214, or if the test press button was not pressed, then controller 40 determines whether New State is equal to True 216. If yes, then state constraints are defined 218. After defining state constraints, or if New State is not equal to True, then controller 40 determines whether the current state equals Abnormal 220, Defrost 222, Dwell 224, Pre-Chill 226, First Cycle 228, or Pull Down 230. If the current state is not set to any of these states, then controller 40 determines whether the fresh food door is open 232, and if yes, sets timer T1 equal to T1-FF Rate 234. If the fresh food door is not open, or after setting timer Ti, then controller 40 checks whether the freezer door is open 236. If the freezer door is open, then controller 40 sets timer T1 equal to T1-FZ Rate 238.

Controller 40 then proceeds to determine whether the compressor is on 240. Controller 40 also proceeds to determine whether the compressor is on 240 if the State is equal to First Cycle 228 or Pull Down 230. If the compressor is not on, then controller 40 checks whether State is equal to First Cycle 242. If yes, controller 40 sets Comp 100% equal to false 244. After setting Comp 100%, or if State is not equal to First Cycle, then controller 40 enters a 50 mSec delay 246 and returns to step 204. If the compressor is on, then controller 40 decrements 248 timer T2.

After decrementing timer T2, or if State is equal to Abnormal, Defrost, Dwell, or Pre-Chill, then controller 40 decrements 250 timer T1. If timer T1 has a value greater than zero 252, then controller 40 checks whether State equals Defrost 254. If no, then controller 40 enters into a delay cycle 246. If yes, then controller 40 checks whether timer T1 has a value less than or equal to abnormal delta time 256. If yes, then the abnormal flag is set 258. After setting the abnormal flag, or if timer T1 has a value greater than the abnormal delta time, then controller 40 checks whether the terminator is open 260. If yes, then State is set equal to Dwell and New State is set equal to True 262. After setting State and New State, or if the terminator is not open, then controller 40 enters the delay cycle 246 and processing returns to step 204.

If timer T1 has a value less than or equal to zero 252, then processing proceeds in accordance with the current state. That is, controller 40 proceeds with processing based on the current state in the sequence illustrated in FIG. 13 and as described below. This sequence is utilized because it controls selection of the next state. More specifically, if State equals Defrost 264, then controller 40 State is set equal to abnormal and New State is set equal to True 266. If State equals Pre-Chill 268, then State is set equal to Defrost and New State is set equal to True 270. If State is equal to Pull Down 272, then State is set equal to Defrost and New State is set equal to True 274. If State is set to Dwell 276, and if the abnormal flag is not set 278, then State is set equal to Compressor and New State is set equal to True 280. If State is set to Dwell 276, and if the abnormal flag is set 278, then State is set equal to Abnormal and New State is set equal to True 282.

If State is equal to First Cycle 284, and if Compressor 100% is not set equal to True 286, the State is set equal to Pre-Chill and New State is set equal to True 288. If State is equal to First Cycle 284 and Compressor 100% is set equal to True 286, then State is set equal to Pull Down and New State is set equal to True 290. If State is set equal to Abnormal 292, then State is set equal to Pre-Chill and New State is set equal to True 294.

If the current state is not equal to Defrost 264, Pre-Chill 268, Pull Down 272, Dwell 276, First Cycle 284, or Abnormal 292, then controller 40 checks whether timer T2 has a value less than or equal to zero 296. If yes, then State is set equal to Pre-Chill and New State is set equal to True 298. After setting State and New State, or if timer T2 has a value greater than zero, then processing proceeds to delay cycle 246, and then to step 204.

As explained above, the processing described in connection with FIG. 13 may be controlled by firmware of microcontroller 40. Such control is believed to facilitate efficient defrost operations.

In addition, four microcontroller inputs are used to change the Pre-Chill and Defrost Heat Times. The times may be selected to allow a single control to be used with different refrigerator models. In addition, a push button (i.e., Switch S1) is used to force the control into a Defrost or a Pre-Chill state. Therefore, for product service and testing, a defrost operation can be initiated upon request. By depressing Switch S1 once, an immediate (no pre-chill) defrost is initiated unless the control is already in the Defrost or Dwell States. After the defrost is initiated, the normal defrost sequence follows and the normal rules as described above determine the start of the next defrost. Further, by double pressing switch S1, a pre-chill state is initiated from any state. The normal defrost sequence follows and the normal rules as described above determine the start of the next defrost. Terminate Defrost can be entered from the Pre-Chill state and then renews the Pre-Chill state to the initial conditions.

Exemplary constant values, as well as minimum and maximums for each constant, are set forth below.

| Constant | Value | Min/Max |
|---|---|---|
| Pre-Chill Time | Jumpers to set 0.5, 1.0, 1.5, or 2.0 hours | 0 to 4 hours |
| Defrost Heat Time | Jumpers to set 24, 35, 40, or 45 minutes | 15 to 60 min |
| Dwell Time | 5 minutes | 0 to 10 min |
| Normal Power Up Time | 2 hours | 0 to 16 hours |
| Pull Down Time | 5 hours | 0 to 16 hours |
| Maximum Time Till Defrost | 60 hours | 6 to 80 hours |
| Minimum Time Till Defrost | 8 hours | 0 to 16 hours |
| Fresh Food Rate | 143 | 0 to 240 |
| Abnormal Defrost Delta Time (=Defrost Heat Time-abnormal time) | 15 minutes | 0 to Defrost Heat Time |
| Abnormal Run Time | 8 hours | 0 to 16 hours |

Many variations of the above described operations are possible. For example, and with respect to pre-chill operations as described above, when the control has determined that a defrost should be initiated, the heating portion of a defrost is preceded by a Pre-Chill Time when the compressor is held on without regard to the cold control demand for cooling. Rather than a set period of time for holding the compressor on during pre-chill, the Pre-Chill Time could be adjusted based on whether the compressor was on when pre-chill is requested. For example, if the compressor is not on when pre-chill is requested, compressor operation would be delayed until the temperature in a refrigerator compartment reaches a preselected temperature. Once the preselected temperature is reached, the compressor is then energized for a fixed period of time, such as 2 hours.

If, however, the compressor is on when pre-chill is requested, then the amount of time that the compressor remains on for pre-chill is adjusted based on how long the compressor had been on in the cycle when the pre-chill request was received. For example, if the compressor had been on for 15 minutes when the pre-chill request was received, then the compressor would remain on for 1 hour and 45 minutes, which provides a total compressor on time of 2 hours. Without such adjustment based on how long the compressor had been on when the pre-chill request was received, the compressor would be on for 2 hours and 15 minutes. In the foregoing example, by operating the compressor for a total of 2 hours rather than for 2 hours and 15 minutes, the desired cooling is achieved and energy savings are provided since the compressor does not operate more than a total of 2 hours during pre-chill even if the pre-chill request is received while the compressor is on.

From the preceding description of various embodiments of the present invention, it is evident that the objects of the invention are attained. Although the invention has been described and illustrated in detail, it is to be clearly understood that the same is intended by way of illustration and example only and is not to be taken by way of limitation. Accordingly, the spirit and scope of the invention are to be limited only by the terms of the appended claims.

What is claimed is:

1. An adaptive defrost control for a refrigerator having a fresh food compartment and a freezer compartment, a fresh food door closing the fresh food compartment and a freezer door for closing the freezer compartment, the refrigerator further including a compressor, said control comprising a controller configured to adjust a compressor run time based on a door open time of at least one of the fresh food compartment door and the freezer compartment door.

2. An adaptive control in accordance with claim 1 wherein said control monitors a compressor voltage to determine compressor run time, and wherein said control monitors a fresh food door switch and a freezer door switch to determine respective door open times.

3. An adaptive control in accordance with claim 2 wherein said controller reduces compressor run time by a factor multiplied by the door open times.

4. An adaptive control in accordance with claim 1 wherein said controller is further configured to monitor the state of the defrost terminator when in a defrost state, and if the terminator transitions from a closed condition to an open condition during defrost, said controller enters a dwell state.

5. An adaptive control in accordance with claim 4 wherein when in the dwell state, said controller does not activate the compressor.

6. An adaptive control in accordance with claim 1 wherein said controller is operable in a pre-chill state in which said controller energizes the compressor.

7. An adaptive control in accordance with claim 1 wherein said controller is operable in a pull down state in which said controller energizes the compressor for a time period equal to a predefined pull down time.

8. An adaptive control in accordance with claim 1 wherein said controller is operable in an abnormal state when a defrost time is longer than an abnormal defrost time or when a defrost state is time terminated, when in the abnormal state, said controller enters a next defrost operation after a fixed period of compressor run time.

9. An adaptive control in accordance with claim 1 wherein said controller is operable in a first cycle state after a power failure, and wherein if the compressor is deenergized during a normal power up time period, said controller enters a pre-chill state, and wherein if the compressor is not deenergized during the normal power up time, said controller enters a pull down state.

10. A cooling apparatus comprising at least one compartment, a door for closing said compartment, a door switch activated by said door, a compressor, and a controller electrically coupled to said door switch and to said compressor, said controller configured to adjust a compressor run time based on a door open time.

11. A cooling apparatus in accordance with claim 10 wherein said compartment comprises at least one of a fresh food compartment and a freezer compartment.

12. A cooling apparatus in accordance with claim 10 wherein said compartment comprises a fresh food door compartment, and wherein said apparatus further comprises a freezer compartment, a freezer door for closing said freezer compartment, and a freezer door switch activated by said freezer door, said controller electrically coupled to said freezer door switch, said controller configured to adjust a compressor run time based on a door open time of said fresh food compartment door and said freezer compartment door.

13. A cooling apparatus in accordance with claim 10 wherein said controller is further configured to monitor the state of the defrost terminator when in a defrost state, and if the terminator transitions from a closed condition to an open condition during defrost, said controller enters a dwell state in which said controller does not activate the compressor.

14. A cooling apparatus in accordance with claim 10 wherein said controller is operable in a pre-chill state in which said controller energizes said compressor, and wherein said controller is operable in a pull down state in which said controller energizes said compressor for a time period equal to a predefined pull down time.

15. A cooling apparatus in accordance with claim 10 wherein said controller is operable in an abnormal state when a defrost time is longer than an abnormal defrost time or when a defrost state is time terminated, when in the abnormal state, said controller enters a next defrost operation after a fixed period of compressor run time.

16. A cooling apparatus in accordance with claim 10 wherein said controller is operable in a first cycle state after a power failure, and wherein if said compressor is deenergized during a normal power up time period, said controller enters a pre-chill state, and wherein if said compressor is not deenergized during the normal power up time, said controller enters a pull down state.

17. A method for determining defrost time in a refrigerator, the refrigerator including at least one compartment, a door for closing the compartment, and a compressor, said method comprising the steps of monitoring door open time, and adjusting compressor run time based on the door open time.

18. A method in accordance with claim 17 further comprising the steps of during a defrost operation, monitoring a status of a defrost terminator, and if the terminator transitions from a closed condition to an open condition during defrost, entering a dwell state in which the compressor is not activated.

19. A method in accordance with claim 17 wherein if a defrost time is longer than an abnormal defrost time or when a defrost state is time terminated, then entering a next defrost operation after a fixed period of compressor run time.

20. A method in accordance with claim 17 wherein in a first cycle state after a power failure, if the compressor is deenergized during a normal power up time period, then entering a pre-chill state, and wherein if the compressor is not deenergized during the normal power up time, then entering a pull down state.

* * * * *